US012807355B2

(12) United States Patent
Pierantoni et al.

(10) Patent No.: US 12,807,355 B2
(45) Date of Patent: Nov. 24, 2026

(54) LAUNCHER OF PAPER PRODUCTS FOR PACKAGING STATIONS OF PAPER PRODUCT CONVERTING LINES

(71) Applicant: Valmet Tissue Converting S.p.A., Lucca (IT)

(72) Inventors: Marco Pierantoni, Valsamoggia (IT); Daniele Bolognesi, Ozzana Dell'Emilia (IT)

(73) Assignee: Valmet Tissue Converting S.p.A., Lucca (IT)

( * ) Notice: Subject to any disclaimer, the term of this patent is extended or adjusted under 35 U.S.C. 154(b) by 100 days.

(21) Appl. No.: 18/870,927

(22) PCT Filed: Jun. 1, 2023

(86) PCT No.: PCT/IB2023/055647
§ 371 (c)(1),
(2) Date: Dec. 2, 2024

(87) PCT Pub. No.: WO2023/233355
PCT Pub. Date: Dec. 7, 2023

(65) Prior Publication Data

US 2025/0353630 A1 Nov. 20, 2025

(30) Foreign Application Priority Data

Jun. 3, 2022 (IT) ..... 102022000011768

(51) Int. Cl.
*B65B 35/54* (2006.01)
*B65B 25/14* (2006.01)
*B65B 59/00* (2006.01)

(52) U.S. Cl.
CPC ..... *B65B 35/54* (2013.01); *B65B 25/145* (2013.01); *B65B 25/146* (2013.01); *B65B 59/005* (2013.01)

(58) Field of Classification Search
None
See application file for complete search history.

(56) References Cited

U.S. PATENT DOCUMENTS 6,523,328 B1 * 2/2003 De Cardenas ..... B65B 61/205 53/399
6,910,313 B2 * 6/2005 De Cardenas ..... B65B 61/205 53/53
11,939,090 B2 * 3/2024 Franzaroli ..... B65B 25/146

FOREIGN PATENT DOCUMENTS

CN 203237435 U 10/2013
CN 211893957 U 11/2020
EP 2720949 B1 * 7/2016 ..... B65B 25/146
(Continued)

*Primary Examiner* — Kavel Singh
(74) *Attorney, Agent, or Firm* — Breiner & Breiner, L.L.C.

(57) ABSTRACT

A launcher of paper products for packaging stations of paper product converting lines, including a frame where at least two launch channels are provided, on which the products to be launched are arranged, and wherein each launch channel has opposite movable surfaces, at least one of which being motorized, arranged in contact with opposite sides of the respective product housed in the channel, to drag the product in the launch direction, characterized in that the two opposite movable surfaces are arranged below and above the space that can be occupied by the product in the respective channel, so as to drag the product by acting on the lower and upper sides thereof.

16 Claims, 8 Drawing Sheets

(56) References Cited

FOREIGN PATENT DOCUMENTS

| | | | |
|---|---|---|---|
| WO | 2014033637 | A1 | 3/2014 |
| WO | 2021053571 | A1 | 3/2021 |

* cited by examiner

LAUNCHER OF PAPER PRODUCTS FOR PACKAGING STATIONS OF PAPER PRODUCT CONVERTING LINES

TECHNICAL FIELD

The present invention relates to the field of paper product packing plants; more in particular, the subject matter of the invention is a launcher of paper products for packaging stations of paper products, such as, for example, rolls or handkerchiefs of so-called tissue paper. A further subject of the invention is a paper products converting line where the step of packing the final product is optimized.

BACKGROUND ART

Paper products, for example tissue paper products, in particular rolls of toilet paper, kitchen towels, interfolded products, handkerchiefs, napkins, paper towels, wipes, cleaning absorbing paper etcetera, are produced on so-called converting lines.

For example, the tissue paper rolls are produced from tissue paper rolls of large diameter, the so-called master rolls or parent reels. One or more parent reels are unwound to supply, with one or more plies of tissue paper, a rewinder, which forms logs, or secondary reels, of axial length equal to the axial length of the parent reels, and diameter equal to the diameter of the finished product destined for consumption. The tissue paper plies coming from the parent reels are bonded together to form a web material, which is wound in secondary reels in a winding cradle of a rewinder.

The winding cradle is typically comprised of a plurality of motorized winding rollers, combined, if necessary, with winding mandrels or tail stocks, for example in some cases when the rolls are formed around tubular winding cores. The winding rollers are kept in rotation at suitable peripheral speeds, and in surface contact with the secondary reel being formed, so as to transmit this secondary reel the torque necessary for winding thereof.

Then, the secondary reels are subjected to a series of further processing, among which: sealing the tail edge of the web material, to prevent it from interfering with the successive steps of the production process, and cutting into single rolls of axial dimension equal to the axial dimension of the finished product intended for consumption. During the cutting step, the ends of the secondary reel, where usually a series of defects in the continuity and thickness of the wound product are concentrated, are trimmed, i.e. cut away. The wastes resulting from cutting the ends are called or "trims"; once they have been cut, they are collected and sent to the pulping mill.

The produced rolls are fed to a packaging station, for example keeping the axis thereof horizontal.

Mainly, the packaging stations have entrance devices, like transport belts, to which launchers are associated, launching the products onto an intermediate module where the products are grouped together and pushed towards a station for the formation of a group of rolls, and towards a vertically movable elevator, thus realizing a group of adjacent rolls, with horizontal axis, in one or more layers Then, the packing machine wraps the group of rolls with a plastic or paper sheet, thus forming the pack of rolls. An example of such a packaging station is disclosed in WO2014033637.

Launchers generally comprise a frame, where at least two launch channels are provided, typically four or five, on which the products to be launched are arranged, and wherein each launch channel has a sliding bottom, on which the products rest, and opposite motorized lateral belts arranged in contact with opposite lateral portions of the respective product housed in the channel, to drag the product in the launch direction.

These packaging stations, even if appreciated by the market thanks to the reliable operation, can be however improved.

In fact, the market of the machines for producing and packing tissue paper products requires lines suitable to continuously increase the production speed and, thus, the packing speed.

The market further requires increasingly performing machines in terms of production flexibility, and therefore in terms of packing flexibility of different products on the same line, thus reducing as much as possible the downtimes necessary to set-up the lines for changing product.

Furthermore, the market often requires more eco-friendly packing systems, i.e. more sustainable, from the environmental point of view, than the known systems.

The known launchers described above are not suitable for the packaging needs in terms of flexibility, with products different in both type and size.

In fact, tissue paper rolls vary greatly in terms of diameter, cutting length, compactness and the like. For example, kitchen towel rolls can have a variable diameter between 90 mm and 300 mm and a height comprised between 200 mm and 280 mm. Toilet paper rolls typically have a diameter between 90 mm and 160 mm and a height between 90 mm and 110 mm.

On the other hand, interfolded products are square packs of handkerchiefs or towels, in which each single sheet is made up of two or more panels folded with one or more folds. Also interfolded products greatly vary in terms of package height and length. The packs of interfolded sheets are generally packaged in small cardboard boxes by cartoning machines, or wrapped in sheets of paper or plastic material.

The launchers of the current art are able to handle only one type of product at a time, i.e. they are able to process a same product having a given length and a given diameter. Changing one of these parameters involves reconfiguring the launcher. Furthermore, the known launchers are not able to process products of completely different types such as rolls and boxes of packets of interfolded handkerchief or towels.

There is therefore the need to increase flexibility with regard not only to the dimensional variability within the same type of product but also to the type of processed products.

SUMMARY

An object of the invention is to provide a launcher of paper products for packaging stations of paper product converting lines, as well as a packing machine for packing tissue paper products, and a converting line comprising a packing machine, adapted to meet the needs in the production of paper products such as toilet paper rolls, kitchen towels rolls, napkins, handkerchiefs, interfolded products, etcetera.

More particularly, an important object of the present invention is to provide a launcher capable of speeding up the format change step of the products to be launched.

A further important object of the present invention is to provide a launcher of paper products which is flexible in use, i.e. which allows to work with products of different types, even simultaneously, and to package the products according to different methods.

These and other objects, which will become clearer hereinafter, are achieved with a launcher of paper products for packaging stations of paper product converting lines, according to the attached claims.

According to a further aspect, the invention relates to a packaging station for making at least one pack of paper products formed by one or more layers of products with at least two types of different products, comprising a launcher according to one or more of the attached claims, a subsequent module for receiving the launched products and a module for making the pack with a plurality of launched products comprised of at least two types of products different from each other.

According to another aspect, the invention relates to a converting line for converting plies of paper or non-woven fabric, wound in parent reels, into products made of paper or non-woven fabric, comprising a packaging station according to one or more of the attached claims; the converting line comprising preferably two or more branches for converting different products made of tissue paper or non-woven fabric, that end in a common packaging station, so that in the station there can be present at the same time at least two types of products different from each other.

According to another aspect, the invention relates to a launcher, a station and a line according to the following clauses:

1. A launcher device of paper products for packaging stations of paper product converting lines, comprising a frame where at least two launch channels are provided, on which the products to be launched are arranged, and wherein each launch channel has opposite movable surfaces, at least one of which being motorized, arranged in contact with opposite sides of the respective product housed in the channel, to drag the product in the launch direction, characterized in that the two opposite movable surfaces are arranged below and above the space that can be occupied by the product in the respective channel, so as to drag the product by acting on the lower and upper sides thereof.
2. The device of clause 1, comprising adjusting means for adjusting the distance between the respective opposite movable surfaces, lower and upper, of at least one launch channel.
3. The device of clause 1 or 2, comprising varying means for varying the position of at least one launch channel in a direction transverse to the launch direction.
4. The device of one or more of the previous clauses, comprising at least two product launching modules, each launch module comprising at least one launch channel.
5. The device of clause 4, wherein an adjusting device is associated with at least one said first launch module for adjusting the distance between the respective opposite movable surfaces, lower and upper, of the respective at least one launch channel; preferably a first adjusting device being associated with a first launch module for adjusting the distance between the respective opposite movable surfaces, lower and upper, of the respective at least one launch channel, and a second adjusting device being associated with a second launch module for adjusting the distance between the respective opposite movable surfaces, lower and upper, of the respective at least one launch channel, so that the distances between the movable surfaces of the at least one launch channel of the first launch module are adjustable independently of the distances between the movable surfaces of the at least one launch channel of the second launch module, so that the at least two launch modules can house products of different heights.
6. The device of clause 5, wherein the adjusting device for adjusting the distance between the respective opposite movable surfaces, lower and upper, of the launch channel provides that the lower movable surface is fixed relative to the frame whilst the opposite upper movable surface is movable to allow adjusting the distance thereof from the lower movable surface.
7. The device of clause 5 or 6, wherein the adjusting device for adjusting the distance between the respective opposite movable surfaces, lower and upper, of a lunch channel comprises a carriage translatable from the top to the bottom and vice versa along a first guiding apparatus associated with the frame; an actuation system being preferably provided, associated with the carriage to allow the movement thereof along the guide in manual or motorized fashion; the actuation system preferably comprising a worm, associated with a manual or electrically motorized control, that has the rotation axis arranged parallel to the guide of the carriage and engages a nut fastened to the carriage.
8. The device of one or more of clauses 4 to 7, wherein the at least one module comprises a varying device for varying the position of the at least one launch channel in a direction transverse to the launch direction; a first varying device is preferably associated with a first launch module for varying the position of the at least one launch channel in a direction transverse to the launch direction, and a second varying device is associated with a second launch module for varying the position of the at least one launch channel in a direction transverse to the launch direction, so that the transverse position of the at least one launch channel of the first launch module can be adjusted independently of the transverse position of the at least one launch channel of the second launch module, so that the at least two launch module can house products of different widths.
9 The device of one or more of the previous clauses, wherein at least one launch channel comprises a lower launching member and an upper launching member, each launching member being provided with a launch belt closed in a loop and defining the respective movable surface adapted to contact the respective side of the product to be launched.
10. The device of clause 9, wherein a motorization is associated with the launch belt, allowing the movement thereof, the motorization being preferably the same for the launch belts of the two launching members of a launch channel, each belt being preferably moved by a respective moving pulley, kinematically connected to a common drive pulley; each upper launching member preferably comprises a transmission wheel moving the respective launch belt closed in a loop, and a transmission shaft is provided coupled to the transmission wheel and the moving pulley, so that the rotation of the transmission shaft causes the launching belt to move, the coupling between the transmission shaft and the transmission wheel being preferably an axially slidable coupling, so that the shaft is able to transmit the angular rotation and to slide axially relative to the wheel, to allow the transverse movement of the launching member, if the transverse position thereof varies.
11. The device of clauses 7 and 9, wherein the upper launching member is arranged on said carriage.

12. The device of clauses 10 and 11, wherein
the pulley moving the launch belt of the upper launching member is provided on said carriage,
the pulley moving the launch belt of the lower launching member is provided on said frame,
the common drive pulley is provided on said frame,
a transmission belt kinematically connects said drive pulley and said pulleys moving the launch belts of the upper and lower launching members.
13. The device of clauses 8 and 9, wherein said upper and lower launching members of a launch channel are arranged on guides transverse to the launch direction and forming part of said device for varying the transverse position of the launch channel.
14. The device of clauses 11 and 13, wherein at least one said transverse guide, on which said upper launching member slides, is arranged on said carriage, whilst another said at least one transverse guide, on which said lower launching member slides, is fixed to the frame; a common moving member being preferably provided, adapted to move said upper and lower launching members of a launch channel in synchronous and equivalent manner; said common moving member comprising preferably an upper worm, parallel to the transverse guides, provided on said carriage and engaging a nut associated with said upper launching member, and a lower worm, parallel to said transverse guides, provided on said frame and engaging a nut associated with said lower launching member, a kinematic mechanism being provided, connecting said two worms and operatively connected to a common rotation actuator.
15. The device of one or more of clauses 4 to 14, wherein two said launch modules are provided and at least one said module comprises at least two said launch channels; preferably both said launch modules comprise at least two launch channels, preferably said two launch modules comprise exactly two launch channels.
16. The device of one or more of the previous clauses, comprising two product launch modules, each module including at least two launch channels, each of which is formed by a lower launching member and an upper launching member, on which the respective lower and upper movable surfaces are defined, each launch module comprising a carriage slidable on said frame from the top to the bottom and vice versa through a first guiding apparatus, on said carriage being provided a second guiding apparatus to allow the transverse movement of the upper launching members, on said frame being provided a further second guiding apparatus to allow the transverse movement of said lower launching member, means being provided for controlling the vertical movement of said carriage and the transverse movement of said lower an upper launching members.
17. The device of one or more of the previous clauses, wherein each launch channel can be actuated independently of another launch channel, so that each launch channel can launch the respective product at a different moment with respect to the launch made by another launch channel.
18. Packaging station for making at least one pack of paper products formed by one or more layers of products with at least two types of different products, comprising a launcher device according to one or more of the previous clauses, a subsequent module for receiving the launched products and a module for making the pack with a plurality of launched products comprised of at least two types of products different from each other.
19. Converting line for converting plies of paper or non-woven fabric wound in parent reels into products made of paper or non-woven fabric, comprising a packaging station according to one or more of the previous clauses; the converting line comprising preferably two or more branches for converting different products made of tissue paper or non-woven fabric, that end in a common packaging station, so that in the station there can be present at least two types of products different from each other.

BRIEF DESCRIPTION OF THE DRAWING

The invention shall be better understood by following the description and the accompanying drawing, which show non-limiting examples of embodiment of the invention. More particularly, in the drawing.

DETAILED DESCRIPTION OF EMBODIMENTS

With reference to the above listed figures, a converting line for converting paper rolls, for instance tissue paper rolls, according to the invention is indicated as a whole with number 10. The line is comprised of two branches, which produce different products, such as, for example, first and second rolls R and R' of different sizes.

A first branch 1A of such converting line 10 therefore comprises, in succession, a converting apparatus T for converting paper plies, wound in large diameter parent reels, into paper rolls with diameter and length equal to those of a first final product (for example rolls R), and ends on a packaging station 30. On the packaging station 30 also a second branch 1B of the converting line 10 ends, that is not described in detail below for the sake of simplicity as it is conceptually similar to the first branch 1A, with second products (for example rolls R' of smaller diameter). By way of example, the rolls R can be rolls of kitchen towels and the rolls R' can be rolls of toilet paper.

Figure 2:
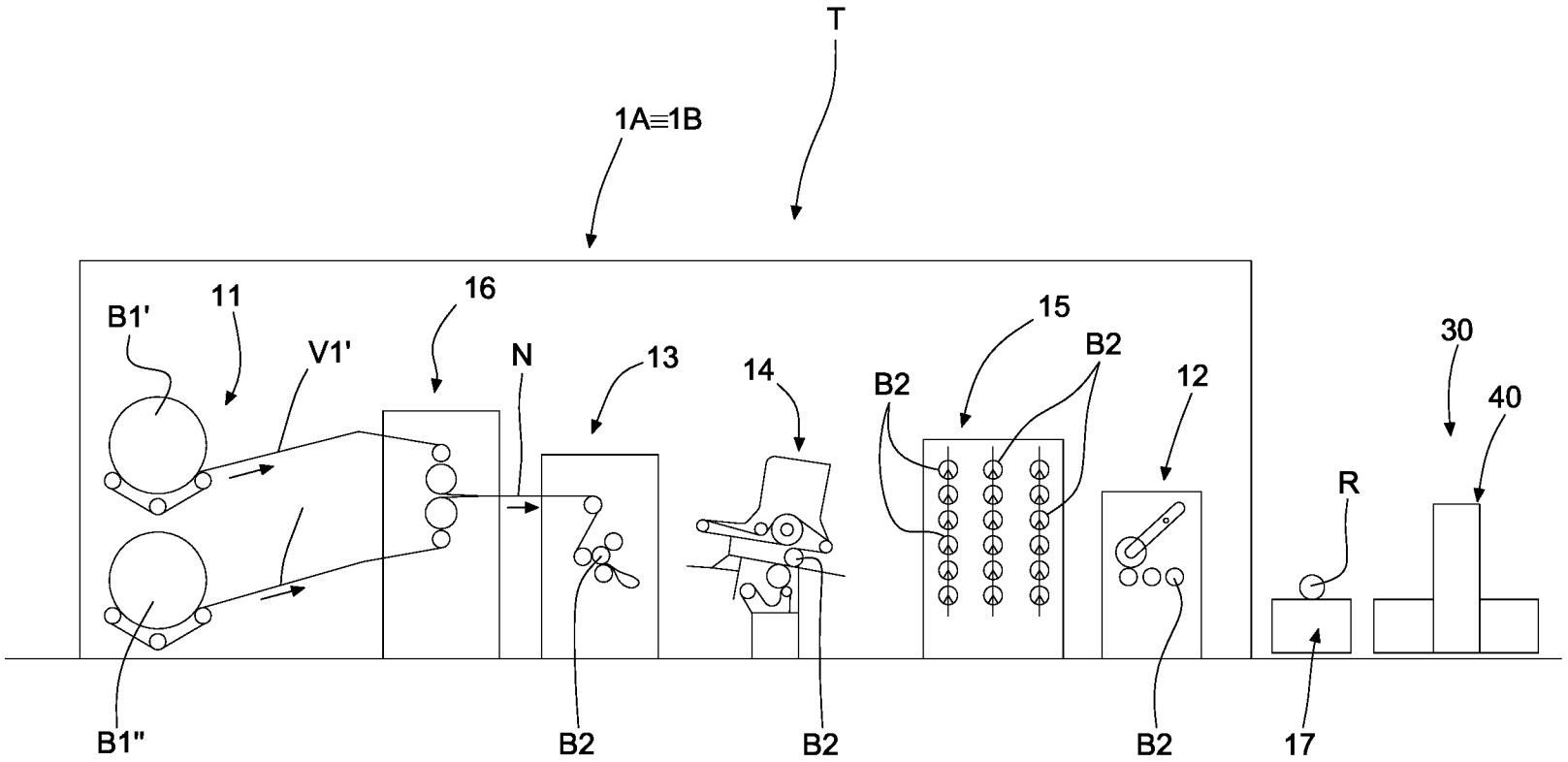
FIG. 2 is a schematic side view of a converting apparatus for converting cellulose plies into paper rolls, for a converting line as per FIG. 1.
Figure 3:
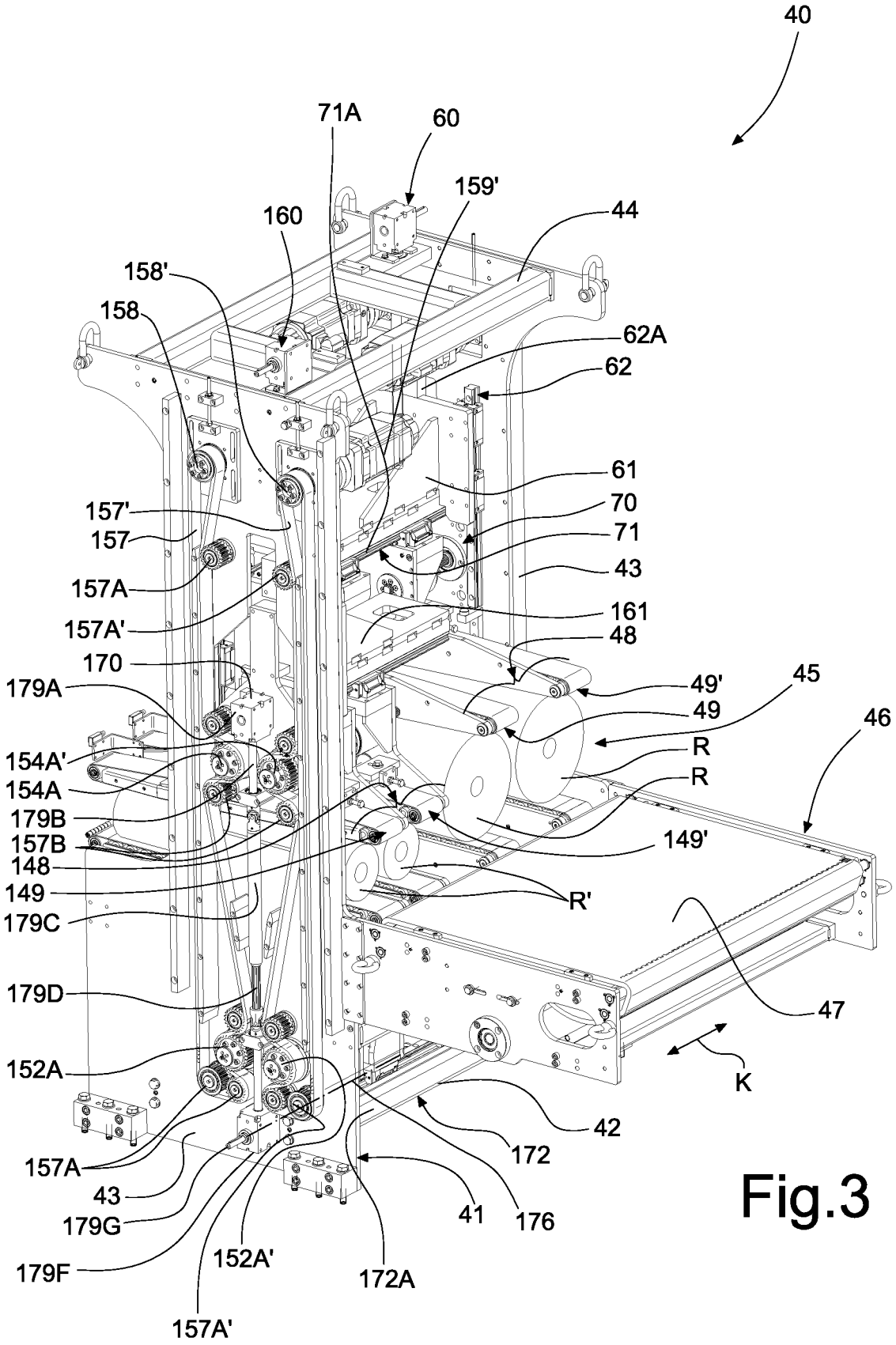
FIG. 3 is a perspective view of the launcher according to the invention.
Figure 4:
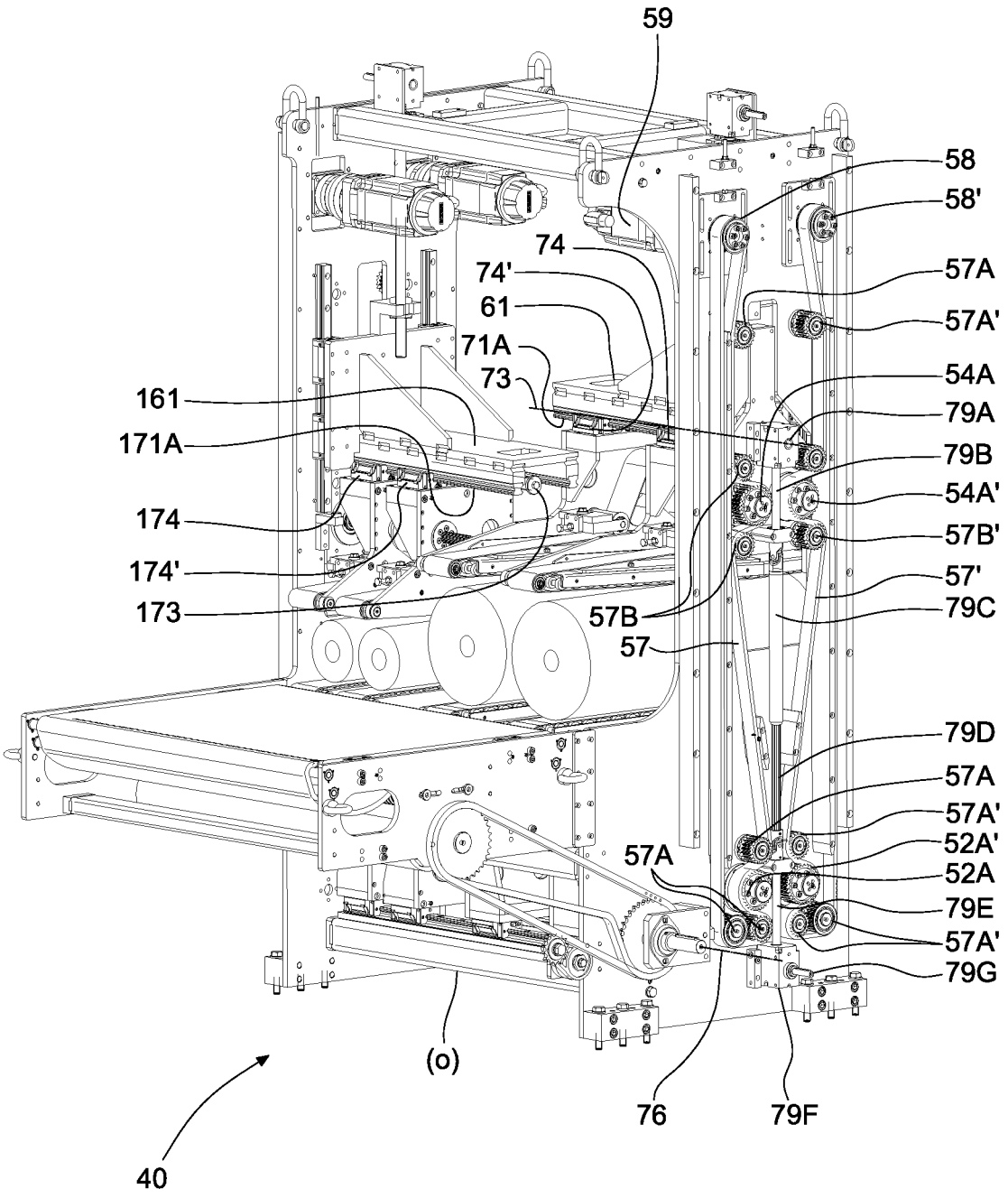
FIG. 4 is a further perspective view of the launcher of FIG. 3.
Figure 5:
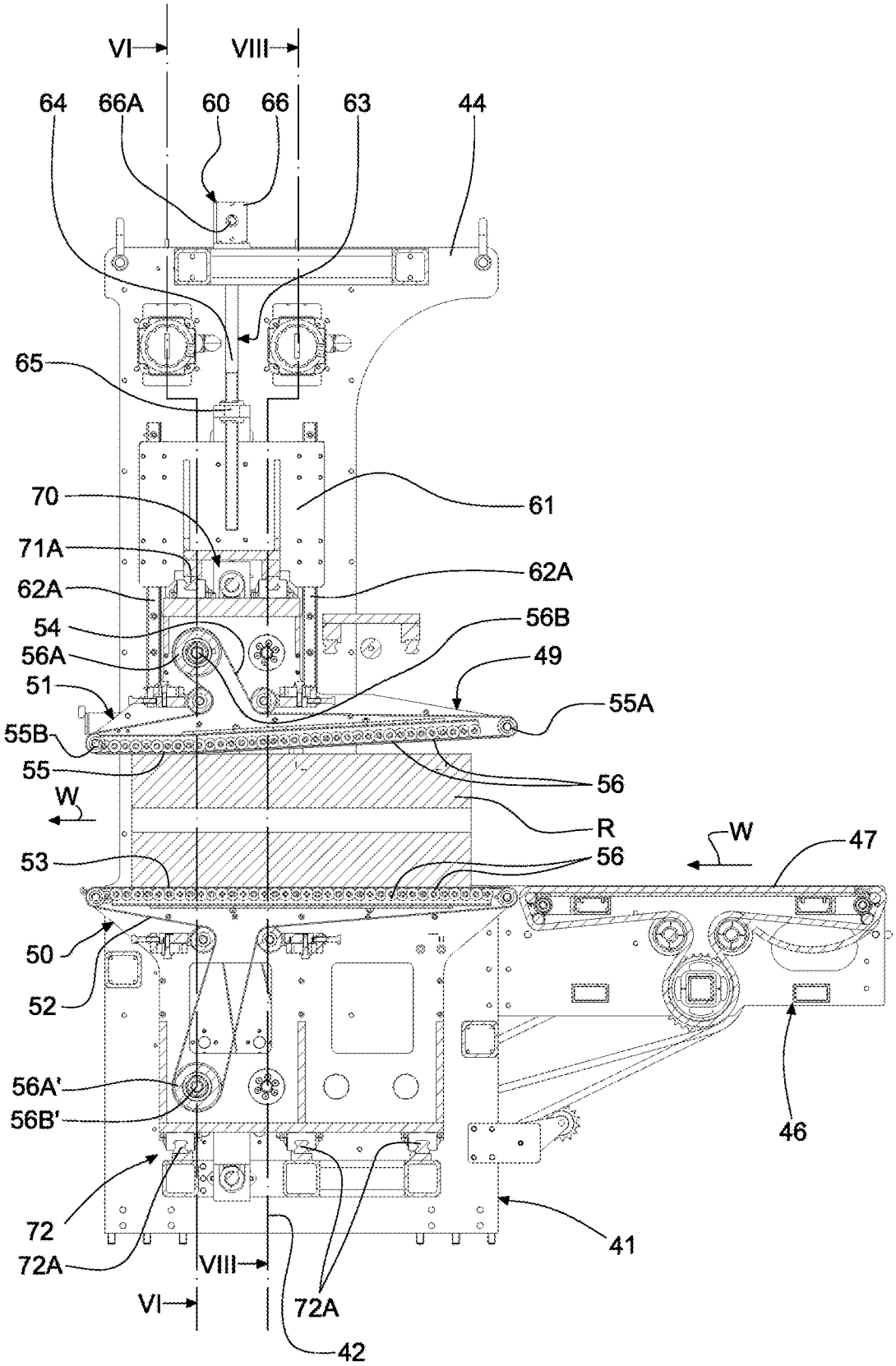
FIG. 5 is a side view of the launcher of FIG. 3 cut-away according to the plane V-V of FIG. 6.
Figure 6:
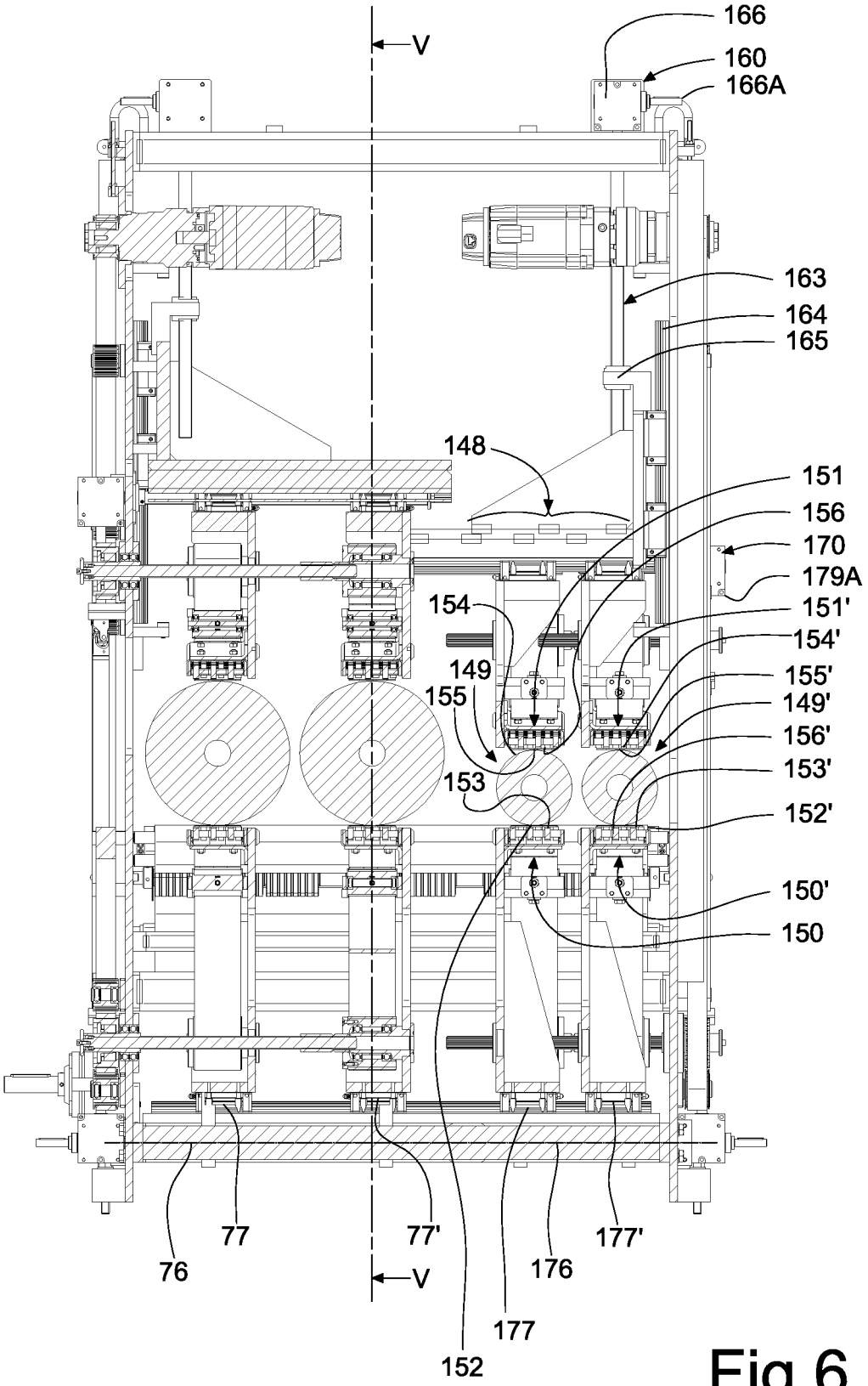
FIG. 6 is a front view of the launcher of FIG. 3 cut-away according to the plane VI-VI of FIG. 5.
Figure 7:
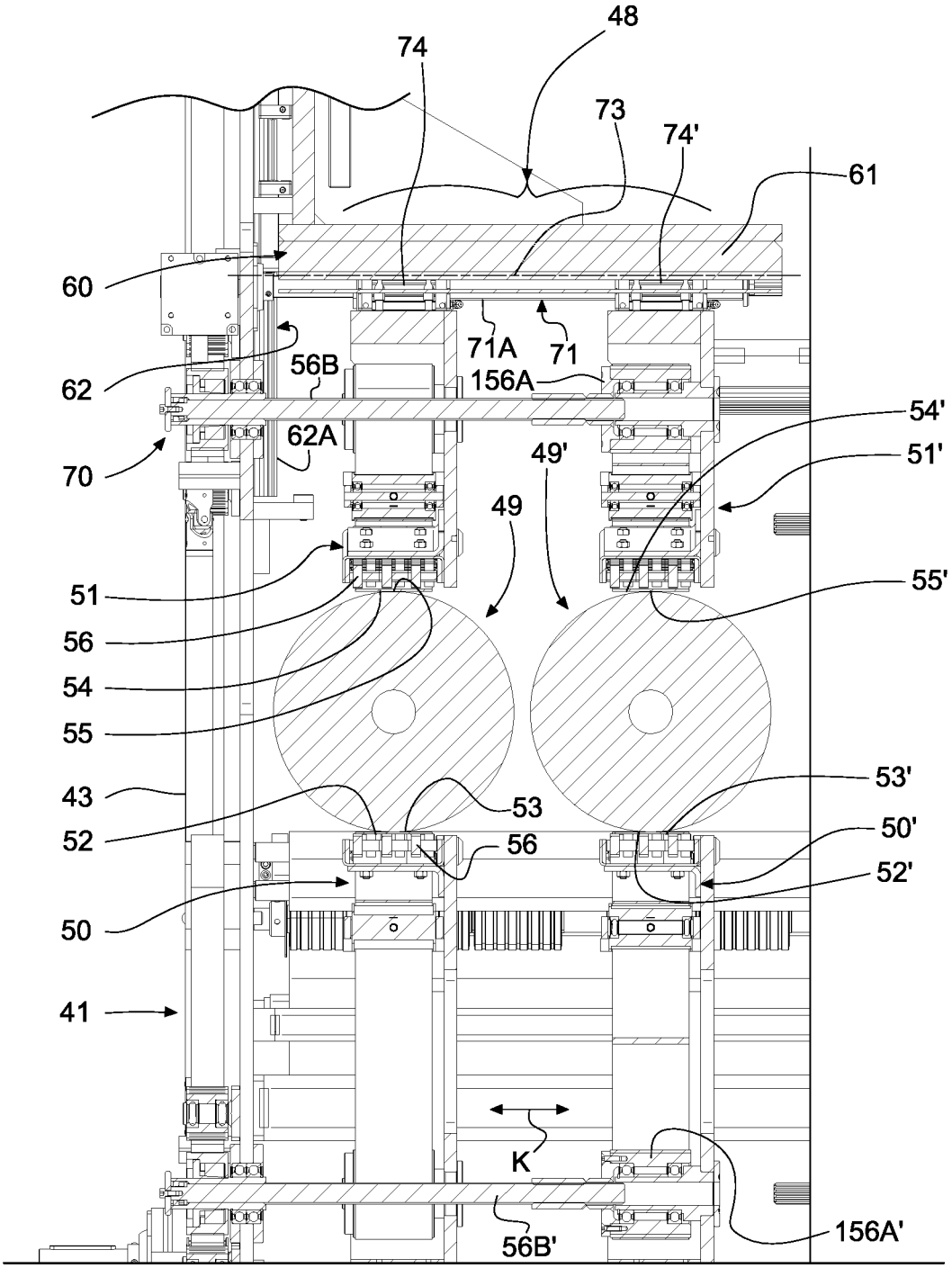
FIG. 7 shows an enlargement of FIG. 6.
Figure 8:
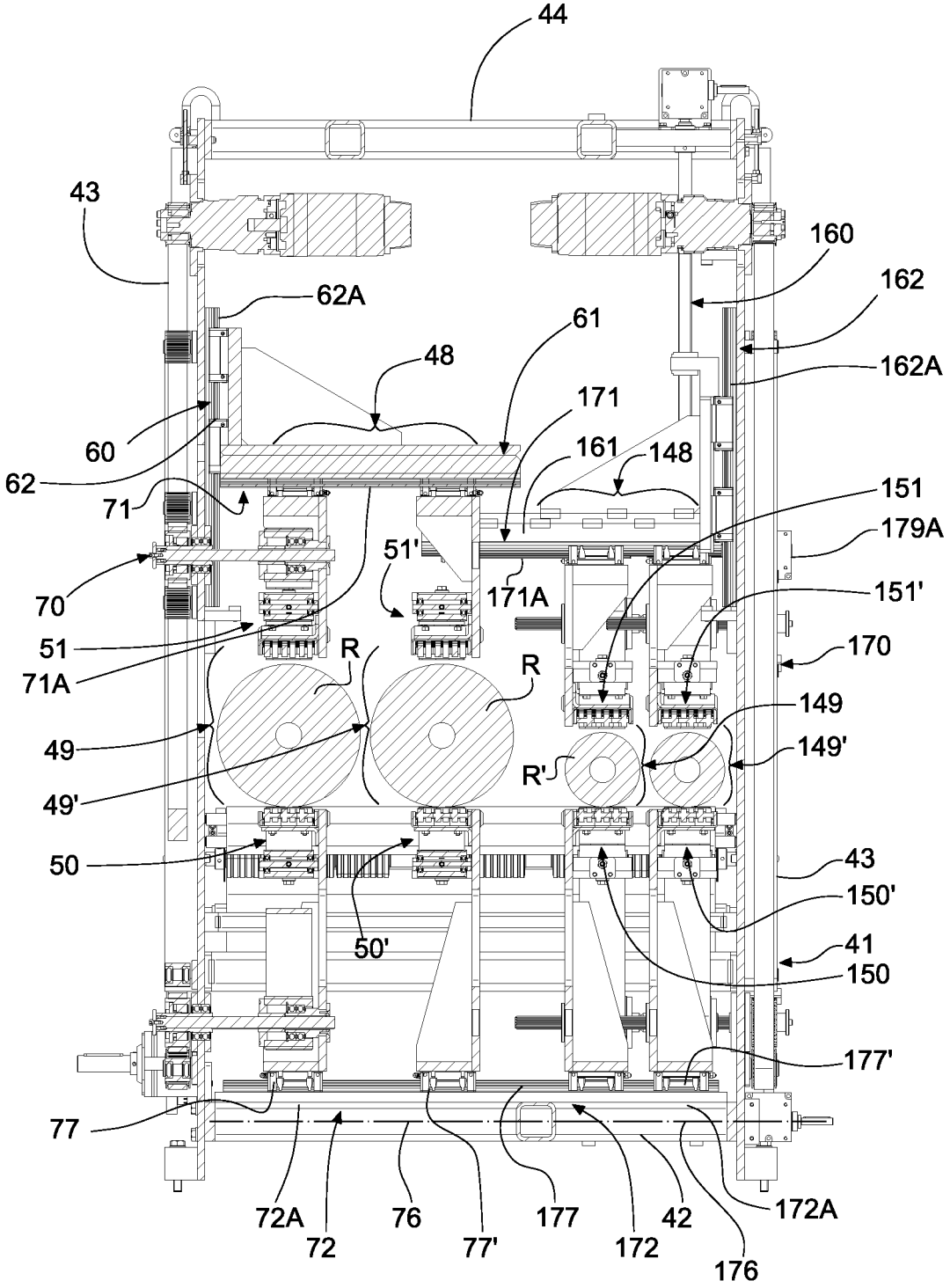
FIG. 8 is a front view of the launcher of FIG. 3 cut-away according to the plane VIII-VIII of FIG. 5.

The converting apparatus T for converting paper plies, wound in parent reels, into paper rolls can comprise a plurality of stations, units, groups or machines, some of which are schematically indicated in FIG. 2. In some embodiments, the apparatus T can comprise an unwinder 11, where one or more large diameter rolls, so-called master rolls or parent reels B1' and B1" can be arranged, on which plies V1', V1" of web material, for example cellulose plies, such as tissue paper plies, are wound. Different types of unwinders are known to those skilled in the art, and can be configured in different ways. The details thereof will not be described herein. In the illustrated example, two parent reels B1' and B1" are provided, which supply two plies V1', V1", but it shall be understood that the number of parent reels and the number of plies supplied from the unwinder 11 can be different.

One or more processing stations for the plies V1', V1" can be arranged downstream of the unwinder 11. For example, a printing station or unit can be provided, for printing one or both the plies, individually or after having bonded them together. In some embodiments, in addition to, or as a replacement of, the printing station or unit, an embossing unit 16 can be provided. The plies V1' and V1" can be embossed and bonded, for example glued, in the embossing unit 16, so as to form a multi-ply web material N.

The web material N is fed to a rewinder 13, for instance a continuous automatic peripheral rewinder, of a known type, where the web material is wound in secondary reels B2, with or without a central winding core. Rewinders are also known to those skilled in the art, and they will not be described in detail herein.

The secondary reels B2 produced by the rewinder 13 have a final free edge, so-called tail edge, that shall be fixed to the outer cylindrical surface of the secondary reel B2 to prevent the secondary reel from opening during the subsequent processing. To this end, downstream of the rewinder 13, a machine 14 for sealing the free edge can be provided, which closes, by gluing, embossing, mechanical ply-bonding or in any other suitable manner, the final edge of each secondary reel B2.

In general, a temporary storage unit 15 is provided downstream of the machine 14 for sealing the free edge, which divides the converting apparatus into two parts, which may have fluctuating production speeds, i.e. production speeds that vary over time differently in the two parts of the apparatus. The temporary storage unit 15 forms a reserve which allows the production speed of the rewinder to vary with respect to the production speed of the machines downstream of the temporary storage unit 15, including a severing machine 12, which cuts the secondary reels B2 into single rolls R. Severing machines are also known to those skilled in the art, and they will not be described in detail herein.

The severing machine 12 also allows cutting the ends of the secondary reel B2, generally defined as "trimmings", which correspond to rolls with dimensions (in terms of axial length) smaller than the final rolls R. The trimmings are wastes that shall be removed from the flow of moving rolls.

The axis z of the rolls R exiting the severing machine is horizontal. The severing machine has preferably two or more cutting channels, where the secondary reels B2 are put and progressively moved forwards during cutting. To each channel of the severing machine 12 corresponds one transport belt, or a plurality of transport belts, 17 conveying the rolls R towards the packaging machine 30. In some embodiments, a single transport belt 17 is provided, with the various channels separated by means of side banks, or a transport belt 17 for each channel, each separated by means of side banks.

On the contrary, a converting line for forming folded products such as wipes, facial tissues or paper towels, not specifically illustrated here, is provided with an interfolding machine instead of a rewinder 13. Therefore, the final products are not rolls, but distinct piles of interfolded paper plies. In this case, the machine for closing the free edge is omitted, but a machine can be provided for wrapping the outer edges of the pile of interfolded sheets. Usually, paper sheets are used for wrapping. The accumulator 15 may be provided or not. A severing machine 12 is provided in this case again, for cutting the wrapped piles into finished products to be packed. Alternatively, the products may be cut without being wrapped in paper, but inserted in cardboard boxes. In this case, by way of example, the products R are rolls of toilet paper or kitchen towels and the products R' are packs of handkerchiefs.

Figure 1:
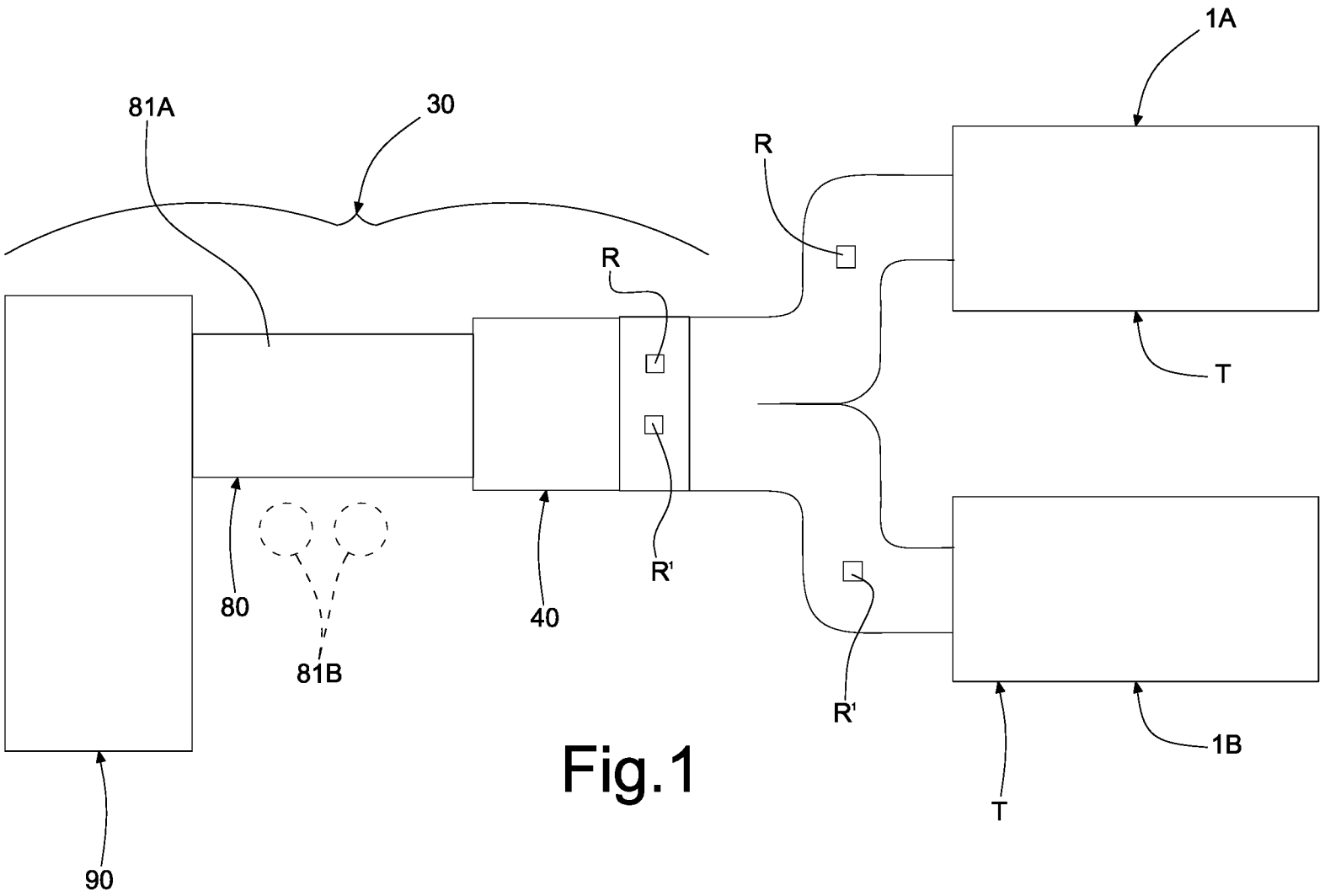
FIG. 1 is a schematic plan view of a converting line with a packaging station provided with a launcher according to the invention.

A further example of converting machine is constituted by the machines for producing napkins, not specifically illustrated herein. In this case, instead of an interfolding machine a folding machine is provided, which adequately folds the paper to form a folded continuous web that is then cut to form napkins with the classical folds ¼, ⅛, ⅙, known to those skilled in the art. Interfolding machines and folding machines for napkins are known to those skilled in the art and will not be described herein. The diagram of FIG. 1 is essentially valid for both the converting lines for forming folded products such as wipes or towels made of paper or non-woven fabric, and the converting lines for forming napkins, provided that the rolls R are considered as packs of paper sheets or possibly of non-woven fabric.

With reference to the disclosed example again, the rolls R are moved by the series of belts 17, keeping the axis thereof horizontally, towards the packaging station 30 (likewise the interfolded and folded products would be transported by belts 17 towards the packaging station 30).

The packaging station 30 comprises: a product launcher 40, which allows the products coming from the branches 1A and 1B to be launched at the desired frequency and order towards a module 80 for receiving the launched products; and a module 90 for making the pack with a plurality of products launched in the receiving module, as better explained below.

The launcher 40 comprises a frame 41 formed by a base structure 42, two flanks 43 and an upper structure 44 in the form of a crossbar, between which an operating space 45 is defined, where the products arrive to be launched with the desired frequency and order (for example first rolls R and second rolls R' of smaller diameter).

An inserting section 46 is provided, which extends in cantilevered manner from the frame 41 and on which a conveyor belt 47 is provided, on which the products to be launched arrive, possibly in groups aligned transversally to the launch direction W. The conveyor belt 47 moves the products in the launch direction towards the operating space 45. In a variant of the invention, the inserting section 46 does not extend in cantilevered manner from the frame 41, but forms part of a conveyor belt arranged upstream of the product launcher 40.

In the operating space 45, launch modules 48, 148 are provided, carrying launch channels 49, 149, each of which allows the launch of a respective product in the launch direction W (launch direction means a bundle of parallel directions, each of which is associated with a respective launch channel, i.e. the products exit the respective launch channels according to parallel directions).

In particular, in this embodiment, a first and a second launch module 48 and 148 are provided. For example, each launch module 48, 148 has a first and a second launch channel 49, 49' and 149, 149'. For the sake of simplicity, particular reference will be made below to the first module 48 and in particular to the first launch channel 49, as the launch channels 49', 149 and 149' have the same features. Below, the same numbers (X) followed by an apex (X'), or preceded by the number 1 (1X), or even preceded by the number 1 and followed by an apex (1X') indicate the same components of the channel 49 but relating to the channels 49', 149 and 149'.

The launch channel 49 (and therefore the channels 49', 149, 149') has a lower launching member 50 (50', 150, 150') and an upper launching member 51 (51', 151, 151'). Each launching member comprises a motorized launch belt, closed in a loop, which defines a movable launching surface which touches a corresponding side of the product to be launched. In particular, the lower launching member 50 has a lower launch belt 52 (52', 152, 152'), which defines a lower movable surface 53 (53', 153, 153'), and the upper launching member 51 has an upper launch belt 54 (54', 154, 154'), which defines an upper movable surface 55 (55', 155, 155'). The movable surfaces 53 and 55, which are thus arranged below and above the space that can be occupied by the product in the respective channel, allow the product to be dragged in the launch direction.

The lower and upper launching members 50 and 51 are vertically aligned, i.e. they have substantially the same transverse position (that is, orthogonal to the launch direction W), so that the respective movable surfaces overlap vertically in a corresponding way, i.e. the respective plan views are superimposed on each other.

In this example, the segments of the launch belts 52, 54 which define the movable surfaces are in contact (on the side which does not face the products to be launched) with a plurality of sliding rollers 56 (56', 156, 156').

The lower movable surface 53 is approximately at the same height as the conveyor belt 47, so as not to hinder the introduction of the products from the conveyor belt, preferably arranged in an approximately horizontal direction.

More preferably, the two lower and upper movable surfaces 53 and 55 (53', 153, 153', 55', 155, 155') are at least partially converging in the launch direction W. For example, the part 55A of the upper movable surface 55 (55', 155, 155') provided at the entrance of the launch channel 49 for the product R to be launched, and the part 55B of the same upper movable surface 55 provided at the exit of the launch channel for the product to be launched, are at different heights, with the entrance part 55A at a greater distance from the lower movable surface 53 with respect to the exit part 55B In particular, the upper launching member 51 is positioned so that the distance of the entrance part 55A from the lower movable surface 53 is greater than the height, in this example a diameter, of the product to be launched through that launch channel. Preferably, to transfer the motion from the launching members to the products, the distance between the lower movable surface 53 and the exit part 55B of the upper movable surface 55 is lower than or equal to the diameter or height of the product to be launched.

Conveniently, the launcher 40 comprises adjusting means for adjusting the distance between the respective opposite lower and upper movable surfaces of the launch channels, so as to adjust the height of the space based on the height of products of different types, as well as varying means for varying the position of the launch channels in the direction K transverse to the launch direction, in order to adjust the space based on the width and type of different products.

For example, an adjusting device 60 (160) is associated with each launch module for adjusting the distance between the respective opposite lower and upper movable surfaces of the respective launch channels. The distances between the movable surfaces of the launch channels of the first launch module are adjustable independently of the distances between the movable surfaces of the launch channels of the second launch module, thus allowing the launcher to house, in the two launch modules, products of different heights.

For example, the adjusting device 60 (160) comprises a carriage 61 (161) slidable on the frame 41 from the top to the bottom and vice versa, preferably in vertical direction. In particular, the carriage 61 is arranged on a first guiding apparatus 62 (162) provided on a flank 43 of the frame 41, for example formed by two first guides 62A (162A). Both the two upper launching members 49, 49' (149, 149') of the launch module 48 (148) are arranged on the carriage 61. As better explained below, a manual or motorized actuation system is associated with the carriage. In the case of a motorized actuation system, it is possible, by means of an operating panel, to adjust the vertical distance between the upper launching members and the lower launching members (these latter, and therefore the respective movable surfaces, are arranged at a fixed height with respect to the frame). In alternative, simpler embodiments, the carriage 61 is not motorized but movable by means of manual hand wheels.

As mentioned above, it is possible to vary the transverse position of the launching members. For example, each launch module comprises a varying device 70 (170) for varying the position of the launch channels transversely to the launch direction, the device comprising for example a second guiding apparatus 71 (171) provided on the respective carriage 61, which comprises for example a plurality of second guides 71A (171A), to allow the transverse displacement of the upper launching members, and a further second guiding apparatus 72 (172) provided on the frame, for example on the base 42, such as for example a plurality of further second guides 72A (172A), to allow an equivalent displacement of the lower launching members. As explained below, means are present which allow the movement of the lower and upper launching members, in manual or motorized fashion.

Downstream of the launcher 40, a subsequent receiving module 80 is provided for receiving the launched products and, downstream of the module 80, a packing module 90 for realizing a pack.

Each launch module can be operated independently of the other, so that each launch module can launch the respective products at a different time from the launch by the other channel, thus making the feeding of the launched products to the subsequent receiving module and packing module flexible.

More preferably, each launch channel 49 is operated independently of another launch channel and in this way each launch channel can launch the respective product at a different time with respect to the launch by another launch channel, thus maximizing even more the flexibility in making the product packs downstream of the launcher.

With reference again to the launcher 40, in this example the adjusting device 60 (160) provides, as mentioned, an actuation system 63 (163) associated with the carriage 61 (161) to allow the movement thereof along the first guides 62A (162A) provided on the flank 43. For example, the actuation system 63 (163) comprises a first worm 64 (164), which extends parallel to the first guides 62A and is coupled to a first nut 65 (165) provided on the carriage 61. This first worm is operatively connected to a moving member or actuator (not shown in the figures for the sake of simplicity), of the manual type (for example a hand wheel), or of the motorized type (for example an electric motor, or an electromechanical actuator, or other). To a rotation of the force output of the actuator corresponds a rotation of the first worm 64 and therefore a vertical movement of the carriage 61, and therefore of the two upper launching members 51, 51' constrained thereto. In this example, the first worm 64 (164) exits from a first transmission gear 66 (166) from which a pin 66A (166A) projects, which is in turn kinematically connected to the actuator.

As regards the implementation of the variation of the transverse position of the launching members, the varying device 70 (170) provides for example a second worm 73 (173) arranged on the carriage 61 (161) parallel to the second guides 71A (171A) with a portion thereof engaging a second nut 74 (174) provided on the first upper launching member and a subsequent portion, which has a thread directed opposite the first portion, which engages a further second nut 74' (174') arranged on the second upper launching member provided on the second guides 71A of the carriage 61. The second worm 73 (173) is kinematically connected to an actuation system, better described below. A rotation of the second worm 73 causes the respective second nuts 74 and 74', and therefore the respective upper launching members arranged slidably on the carriage 61, to move towards or away from each other, depending on the direction of rotation of the worm.

Analogously, as regards the lower launching members arranged on the further second transverse guides 72A (172A), the varying device 70 (170) provides for example a further second worm 76 (176) arranged on the frame 41 parallel to the further second guides 72A (172A) with a portion thereof engaging a third nut 77 (177) provided on the first lower launching member and a subsequent portion, which has a thread directed opposite the first portion, which engages a further third nut 77' (177') arranged on the second upper launching member provided on the further second guides 72A (172) of the carriage 61 (161). The further second worm 76 is kinematically connected to an actuation system, better described below. A rotation of the further second worm 76 causes the respective third nuts 77 and 77', and therefore the respective upper launching members arranged slidably on the carriage 61, to move towards or away from each other, depending on the direction of rotation of the worm.

Alternatively, it is possible to adjust the mutual transverse distance of the launching members by using the further second worm 76 (176) divided into two portions, the first portion associated for example with the launcher 49 (149) which engages a third nut 77 (177), and the second portion associated with the launcher 49' (149') which engages the further third nut 77' (177'), wherein the second portion of the worm 76 (176) has a thread with a pitch double that of the first portion. In this way, by rotating the further second worm 76 (176) it is possible to move the launchers from a side of the flank 43 towards the center of the launcher 40. The double pitch of the second portion of the worm 76 (176) allows the innermost channel to create the space for the outermost channel and the space necessary for product change when this involves processing products of larger dimension.

Adequately, in this example, the second worm 73 (173) and the further worm 76 (176), are so actuated as to provide equivalent displacements of the respective lower and upper launching members, so that they are always in the same transverse position, i.e. always superimposed in the same way. To do this, preferably, the second worm and the further second worm are kinematically connected to a same actuation system. For example, the second worm 73 has one end engaged by a second transmission gear 79A (179A) provided on the carriage 61 (161).

A first part 79B (179B) of transmission shaft extends downwards (for example vertically) from the second transmission gear 79A (179A), this first part being coupled, through a first universal joint, to a coaxial second part 79C (179C) of transmission shaft, within which a third part 79D (179D) of transmission shaft slides axially. This slidable coupling (with rotational engaging) allows the translation of the carriage 61, to which the second part 79C of transmission shaft is constrained.

The third part 79D (179D) of transmission shaft is coupled, by means of a second universal joint, to a fourth part 79E (179E) of transmission shaft, the fourth part being finally coupled to a third transmission gear 79F (179F). Also the further second worm 76 (176) exits from the third transmission gear 79F (179F). A pin 79G (179G) protrudes from the third transmission gear 79F (179F), the pin being operatively connected to a motorization (not shown in the figures for the sake of simplicity), such as a motor or an electromechanical actuator, or other. An action of this motorization causes a rotation of the pin 79G (179G), which activates the further second worm and therefore causes the movement of the lower launching members. Simultaneously, the action of the motorization causes the rotation of the transmission shaft 79B-79E (179B-179E) exiting from the third transmission gear 79F (179F) and therefore, through the transmission gear 79A (179A), the rotation of the second worm 73 (173) and therefore the displacement of the upper launching members.

As regards the movement of the movable launch surfaces, each upper and lower launching member is closed in a loop and comprises a transmission wheel 56A (56A', 156A, 156A'), which moves the respective launching belt closed in a loop (driven between return and tensioning rollers). A transmission shaft 56B, 56B' is provided, coupled to the transmission wheel 56A (56A', 156A, 156A') of the upper launching member, so that the rotation of the transmission shaft causes the movement of the launch belt of the upper launching member. It should be noted that the coupling between transmission shaft 56B (56B', 156B, 156B') and transmission wheel 56A (56A', 156A, 156A') is of the axially slidable type, so that the shaft is adapted to transmit the angular rotation and to slide axially with respect to the wheel, to allow the transverse movement of the launching member, when it is necessary to vary the transverse position thereof. As mentioned above, each launch belt 52-54 (52'-54', 152-154, 152'-154') is closed in a loop and has, for each launch channel of the launch module, a respective first and second moving pulley 52A-54A (52A'-54A', 152A-154A, 152A'-154A') arranged at the ends of respective transmission shafts to transmit motion to the transmission wheels 56B-56B', 156B-156B'). The moving pulleys are operatively connected, by means of a transmission belt 57 (57', 157, 157'), to a drive pulley 58 (58', 158, 158') pivoted to a flank 43, that is in turn operatively connected to a motorization 59 (59', 159, 159').

More specifically, a first moving pulley 52A for moving the launch belt 52 of the lower launching member is pivoted to the frame, for example to the flank 43 thereof. A second moving pulley 54A for moving the launch belt 54 of the upper launching member is pivoted to the carriage 63.

Rollers are provided for returning and tensioning the transmission belt 57, the rollers pivoted to the frame being indicated as a whole with the reference number 57A (57A', 157A, 157A'), and the rollers pivoted to the carriage 63 being indicated as a whole with the reference number 57B (57B', 157B, 157B').

Each launcher therefore has a respective motorization 59 (59', 159, 159'), which allows each launch to be managed independently for each channel. This aspect is particularly advantageous when products of different sizes shall be launched. For example, launching a kitchen towel roll causes the rolls to advance by a greater entity with respect to a toilet paper roll. In addition, the independent motorization allows to correct any misalignment of the products to be launched. For example, a control algorithm can be performed as disclosed in EP2763917B1.

In practice, the launcher 40 can consist of launch modules. Each launch module can include one or more adjacent launch channels. In the shown example, two launch modules are provided, and two launch channels, indicated respectively by 49, 49' and 149, 149', are provided for each module. It is easy to understand that it is possible to have more than two launch channels for each module in order to have the desired number of launch channels (both per module and in total). Furthermore, it is possible to have more than two modules to be able to launch simultaneously more than two products independently. This solution allows to launch, simultaneously and independently, for example, toilet paper rolls, kitchen towel rolls and packs of handkerchiefs or interfolded products. Finally, the launcher 40 can have one or more launch modules and each launch module can have a different number of launch channels. This solution is particularly flexible and allows to manage the products in a targeted way, as it is possible to launch a greater amount of one type of product with respect to another. For example, with this solution it is possible to launch a large diameter kitchen towel roll, two toilet paper rolls and three packs of interfolded products, if the launcher 40 consists of three modules having one, two and three channels respectively. Clearly, any desired configuration can be realized.

Furthermore, each channel can launch independently for each packaging cycle a number of products greater than or equal to one, based on the type of machine arranged downstream, i.e. according to the module 80 for receiving the launched products and the module 90 for realizing the pack.

As mentioned above, the packaging station 30 has a product launcher 40, which allows the products coming from the branches 1A and 1B to be launched with the desired frequency and order towards a module 80 for receiving the launched products and a module 90 for making the pack with a plurality of products launched in the receiving module.

For example, the set comprised of module 80 and module for making the pack can be as disclosed in one or more embodiments of the patent application WO2021053571. For example, according to what disclosed there, the receiving module 80 can be formed by one or more conveyor belts 81A, from which one or more anthropomorphic robots 81B collect the products launched by the launcher 40 in the belt 81A and insert them into boxes, subsequently wrapped in a film or arranged on pallets in module 90; or the robots group the products into groups that are then processed in the module 90 to be wrapped in packaging film.

It is understood that what is illustrated purely represents possible non-limiting embodiments of the invention, which may vary in forms and arrangements without departing from the scope of the concept on which the invention is based. Any reference numerals in the appended claims are provided for the sole purpose of facilitating the reading thereof in the light of the description above and the accompanying drawings and do not in any way limit the scope of protection.

The invention claimed is:

1. A launcher of paper products for packaging stations of paper product converting lines, comprising a frame where at least two modules for launching the products are arranged, each module of said at least two modules comprising at least one launch channel, so that the launcher comprises at least two launch channels, on which the products to be launched are arranged, and wherein each launch channel of said at least two launch channels has opposite movable surfaces, with at least one of said opposite movable surfaces being motorized, arranged in contact with opposite sides of a respective product housed in the launch channel, to drag the product in a launch direction, wherein the two opposite movable surfaces are arranged below and above, respectively to provide a lower movable surface and an upper movable surface, a space that can be occupied by the product in a respective one of said at least one launch channel, so as to drag the product by acting on the lower side and the upper side thereof, wherein a device is associated with at least one module of said at least two modules for adjusting a distance between the lower movable surface and the upper movable surface of a respective one of the two opposite movable surfaces of a respective one of said at least one launch channel including at least a first adjusting device being associated with a first launch module for adjusting distance between the respective opposite movable surfaces of the respective at least one launch channel, and a second adjusting device being associated with a second launch module for adjusting distance between the respective opposite movable surfaces of the respective at least one launch channel, so that distances between the movable surfaces of the at least one launch channel of the first launch module are adjustable independently of distances between the movable surfaces of the at least one launch channel of the second launch module, so that the at least two launch modules can house products of different heights;

wherein at least one launch channel of said at least two launch channels comprises a lower launching member and an upper launching member, each of said lower launching member and said upper launching member being provided with a launch belt closed in a loop and defining a respective one of said at least two opposite movable surfaces adapted to contact a respective side of the product to be launched;

wherein the upper launching member is arranged on the carriage; and wherein a first transverse guide, on which said upper launching member slides, is arranged on said carriage, while a second transverse guide, on which said lower launching member slides, is fixed to the frame; a common moving member is provided and adapted to move said upper launching member and said lower launching member in a synchronous and equivalent manner.

2. The launcher of claim 1, further comprising varying means for varying a position of said at least one launch channel in a direction transverse to the launch direction.

3. The launcher of claim 1, wherein said device for adjusting the distance between the respective one of the two opposite movable surfaces of the at least one launch channel provides that the lower movable surface is fixed relative to a frame while the upper movable surface is movable to allow adjusting distance thereof from the lower movable surface.

4. The launcher of claim 1, wherein said device for adjusting the distance between the respective one of the two opposite movable surfaces comprises a carriage translatable from top to bottom and vice versa along a first guiding apparatus associated with the frame; an actuation system associated with the carriage to allow movement of the carriage along a guide manually or by a motor; said actuation system comprising a worm, associated with a manual or electrically motorized control, that has a rotation axis arranged parallel to the guide of the carriage and engages a nut fastened to the carriage.

5. The launcher of claim 1, wherein the at least one module comprises at least one varying device for varying the position of the at least one launch channel in a direction transverse to the launch direction; wherein a first of said at least one varying device is associated with a first launch module of said at least two modules for varying a position of the at least one launch channel in a direction transverse to the launch direction, and a second varying device of said at least one varying device is associated with a second launch module of said at least two modules for varying the position of said at least one launch channel in a direction transverse to the launch direction, so that the transverse position of the at least one launch channel of the first launch module is adjustable independently of the transverse position of the at least one launch channel of the second launch module, so that said at least two modules can house products of different widths.

6. The launcher of claim 1, wherein a motorization is associated with said launch belt allowing movement of the launch belt; the motorization being the same for each said launch belt of the upper launching member and the lower launching member, each said launch belt being moved by a respective moving pulley kinematically connected to a common drive pulley; each said upper launching member comprises a transmission wheel moving a respective one of said launch belt closed in a loop, and a transmission shaft is provided coupled to said transmission wheel and said moving pulley, so that rotation of the transmission shaft causes the launching belt to move, coupling between the transmission shaft and the transmission wheel being an axially slidable coupling so that the transmission shaft is able to transmit angular rotation and to slide axially relative to the transmission wheel to allow transverse movement of the launching member when a transverse position thereof varies.

7. The launcher of claim 6, wherein the respective moving pulley moving the launch belt of the upper launching member is provided on the carriage, the respective moving pulley moving the launch belt of the lower launching member is provided on the frame, said common drive pulley is provided on said frame, a transmission belt kinematically connects said common drive pulley and said moving pulley moving the launch belt of each of the upper launching member and the lower launching member.

8. The launcher of claim 1, wherein the moving pulley moving the launch belt of the upper launching member is provided on the carriage, the moving pulley moving the launch belt of the lower launching member is provided on the frame, said common drive pulley is provided on said frame, a transmission belt kinematically connects said common drive pulley and said moving pulley moving the launch belts of each of the upper launching member and the lower launching member.

9. The launcher of claim 1, wherein said common moving member comprising an upper worm, parallel to said first transverse guide, provided on said carriage and engaging a nut associated with said upper launching member, and a lower worm, parallel to said second transverse guide, provided on said frame and engaging a nut associated with said lower launching member; a kinematic mechanism being provided, connecting said upper worm and said lower worm and operatively connected to a common rotation actuator.

10. The launcher of claim 1, wherein two of said at least two launch modules are provided and at least one of said at least two launch modules comprises at least two of said launch channels; and wherein both said two launch modules comprise at least two launch channels, said two of said at least two launch modules comprise two launch channels.

11. The launcher of claim 1, further comprising two modules of said at least two modules for launching the products, each of said two modules including at least two launch channels, each of said at least two launch channels is formed by a lower launching member and an upper launching member, on which a respective one of said lower movable surface and the upper movable surface are defined, each of said two modules comprising a carriage slidable on said frame from top to bottom and vice versa through a first guiding apparatus, on said carriage being provided a second guiding apparatus to allow transverse movement of the upper launching member, on said frame being provided a further second guiding apparatus to allow transverse movement of said lower launching member, means controlling vertical movement of said carriage and transverse movement of said lower launching member and the upper launching member is provided.

12. The launcher of claim 1, wherein each of said at least one launch channel can be actuated independently of another one of said at least one launch channel, so that said each launch channel can launch a respective one of the product at a different moment with respect to a launch made by another launch channel.

13. A packaging station for making at least one pack of paper products formed by one or more layers of products with at least two types of different products, comprising a launcher according to claim 1, a subsequent module for receiving launched products and a module for making the pack with a plurality of launched products comprised of at least two types of products different from each other.

14. A converting line for converting plies of paper or non-woven fabric, wound in parent reels, into products made of paper or non-woven fabric, comprising a packaging station according to claim 13; said converting line comprising two or more branches for converting different products made of tissue paper or non-woven fabric, that end in a common packaging station, so that in said station can be present at the same time at least two types of products different from each other.

15. A launcher of paper products for packaging stations of paper product converting lines, comprising a frame where at least two modules for launching the products are arranged, each module of said at least two modules comprising at least one launch channel, so that the launcher comprises at least two launch channels, on which the products to be launched are arranged, and wherein each launch channel of said at least two launch channels has opposite movable surfaces, with at least one of said opposite movable surfaces being motorized, arranged in contact with opposite sides of a respective product housed in the launch channel, to drag the product in a launch direction, wherein the two opposite movable surfaces are arranged below and above, respectively to provide a lower movable surface and an upper movable surface, a space that can be occupied by the product in a respective one of said at least one launch channel, so as to drag the product by acting on the lower side and the upper side thereof, wherein a device is associated with at least one module of said at least two modules for adjusting a distance between the lower movable surface and the upper movable surface of a respective one of the two opposite movable surfaces of a respective one of said at least one launch channel including at least a first adjusting device being associated with a first launch module for adjusting distance between the respective opposite movable surfaces of the respective at least one launch channel, and a second adjusting device being associated with a second launch module for adjusting distance between the respective opposite movable surfaces of the respective at least one launch channel, so that distances between the movable surfaces of the at least one launch channel of the first launch module are adjustable independently of distances between the movable surfaces of the at least one launch channel of the second launch module, so that the at least two launch modules can house products of different heights;

wherein at least one launch channel of said at least two launch channels comprises a lower launching member and an upper launching member, each of said lower launching member and said upper launching member being provided with a launch belt closed in a loop and defining a respective one of said at least two opposite movable surfaces adapted to contact a respective side of the product to be launched;

wherein said upper launching member and the lower launching member are arranged on guides transverse to the launch direction and form part of a device for varying transverse position of the launch channel; and wherein at least one of said guides transverse to the launch direction on which said upper launching member slides is arranged on said carriage, while another of said transverse guides on which said lower launching member slides is fixed to the frame; a common moving member being provided and adapted to move said upper launching member and said lower launching member in a synchronous and equivalent manner.

16. The launcher of claim 15, wherein said common moving member comprising an upper worm, parallel to said transverse guides, provided on said carriage and engaging a nut associated with said upper launching member, and a lower worm, parallel to said transverse guides, provided on said frame and engaging a nut associated with said lower launching member, a kinematic mechanism connecting said upper worm and said lower worm and operatively connected to a common rotation actuator.

* * * * *